United States Patent [19]

Dixon et al.

[11] 4,363,367

[45] Dec. 14, 1982

[54] LARGE DIAMETER DRILL BIT

[75] Inventors: Robert L. Dixon, Brea; Malcolm D. Maxsted, Harbor City, both of Calif.

[73] Assignee: Smith International, Inc., Newport Beach, Calif.

[21] Appl. No.: 314,803

[22] Filed: Oct. 26, 1981

[51] Int. Cl.[3] ..... E21B 10/10; E21B 10/18

[52] U.S. Cl. ..... 175/340; 299/81; 299/90

[58] Field of Search ..... 175/329, 339, 340, 393; 299/81, 90

[56] References Cited

U.S. PATENT DOCUMENTS

| | | | |
|---|---|---|---|
| 2,201,219 | 5/1940 | Bell | 175/377 X |
| 2,811,341 | 10/1957 | Robbins | 299/90 |
| 2,838,284 | 6/1958 | Austin | 175/329 |
| 3,292,719 | 12/1966 | Schumacher, Jr. | 175/339 |
| 3,358,783 | 12/1967 | Raynal et al. | 175/393 |
| 3,548,949 | 12/1970 | Hasiba | 175/393 |
| 3,951,220 | 4/1976 | Phillips, Jr. et al. | 175/393 |
| 4,007,799 | 2/1977 | Dixon et al. | 175/340 |
| 4,125,167 | 11/1978 | Evans et al. | 175/65 |
| 4,192,556 | 3/1980 | Grandori | 299/90 |
| 4,227,583 | 10/1980 | Benjamin | 175/65 |

*Primary Examiner*—Stephen J. Novosad
*Assistant Examiner*—Joseph Falk
*Attorney, Agent, or Firm*—Robert G. Upton

[57] ABSTRACT

A drill bit is disclosed for drilling large diameter shafts. The drill bit comprises a main bit body having a plurality of cutter assemblies rotatively mounted on the lower side thereof. The cutters contact and disintegrate the earth formations at the bottom of the shaft, thereby creating rock chips. The cutters are strategically located along arcuate paths and extending generally from the bit gage or periphery to the center of the bit. An arcuate channel is formed by the bit body to house the cutters and to provide a high velocity flow path for drilling fluid which engulfs all the cutters and flushes the rock chips away during operation of the bit. Drilling fluid containing rock chips enters the drillstring at the center of the bit body and is then pumped up and out of the shaft being drilled.

14 Claims, 7 Drawing Figures

LARGE DIAMETER DRILL BIT

BACKGROUND OF THE INVENTION

1. Field of the Invention

The subject matter of this patent relates generally to the art of drilling large diameter shafts in the earth and, more particularly, to the expeditious removal of cuttings from the shaft bottom during the drilling operations.

2. Description of the Prior Art

Large diameter shafts are used to provide general access to an ore body in mineral mining practice.

Large diameter shafts are commonly drilled with rotary drill bits which comprise a main bit body having a plurality of cutter assemblies rotatively mounted thereto. The cutters contact and disintegrate the earth formation at the bottom of that shaft, thereby producing cuttings or detritus at that location.

Drilling fluids or "mud" are employed to hydraulically purge the drilling surface of cuttings.

Various circulation systems for drilling fluids have evolved.

The "reverse" circulating system is commonly used in drilling large diameter shafts. Mud is supplied to the annulus of the shaft by pumping mud down the outside of the drillstring between the conduit and the shaft wall. The fluid flows across the bit face from the peripheral edge of the bit to the center of the bit to be pumped up the drill column along with the purged cuttings.

Another version of the reverse circulation systems utilizes a dual-string drill column, which is a concentric pipe within a pipe. The mud is pumped down the annular space between the inner and outer conduits, distributed via plumbing within the bit, and then pumped along with the entrained cuttings up the interior of the smaller inside pipe of the drill column.

U.S. Pat. No. 3,471,177 teaches the construction of a dual-string reverse circulation drilling column, however, the patent does not teach its application to a reverse circulation system for a large diameter drill bit.

Present day circulation systems are inefficient for transporting the drilled cuttings across the bottom of the shaft and out of the path of advancing cutters. Consequently the cuttings generally are recut to smaller sizes, until the drilling fluid circulation finally does sweep them away. This repeated recutting is wasteful of drilling energy and is deleterious to cutter life and to rate of penetration of the rock bit.

U.S. Pat. Nos. 4,105,083; 4,195,700 and 4,200,160 describe sweeps or brushes attached to large diameter bits which are intended to meet the problem of moving chips out of the path of advancing cutters.

An advantage of this invention over the prior art is the concentration of drilling mud along an arcuate flow path or channel formed by the bit body to direct drilling mud from a peripheral edge of the bit, across the cutters strategically positioned within the channel and through the center of the bit, thus efficiently moving detritus material from the boreface.

Another advantage over the prior art is the ability to cool and clean each cutter strategically positioned within the arcuate channels formed by the large diameter bit body to prevent "balling" of the cutters, thereby further enhancing the penetration rate of the bit.

SUMMARY OF THE INVENTION

The present invention obviates the aforementioned shortcomings by providing a large diameter drill bit having an improved bottom hole cleaning system.

In its broadest aspect, the present invention pertains to a large diameter drill bit comprising a main bit body having a plurality of roller cutters mounted thereon. A circulation system is provided for pumping drilling fluid across the face of the main bit body. The cutters are strategically located within a relatively narrow, high velocity, fluid flow channel along an arcuate path from a peripheral point on the main bit body to a central opening in communication with the interior of the drill column.

In the preferred embodiment, adaptation to a dual-string drill column is utilized. The arcuate path is substantially a spiral in order to accommodate progressively larger radial cutting paths to provide an even distribution of cutter wear.

In another embodiment, adaptation to a single drill column is utilized.

In either embodiment, an alternate arcuate path, following substantially an involute curve, may be used for less critical applications.

The use of flexible side skirts to better confine the fluid flow; the use of a surface member substantially parallel to the cutting plane of the bit to further restrict the flow channel; the use of a semi-rigid material to exclude fluid and cuttings from the space restricted by such a surface; and the use of various baffles or directive vanes to promote cleaning of individual cutters are features of the instant invention which may be used singularly or in any combination with either embodiment of this invention.

A primary purpose of the present invention is to provide a very high velocity fluid flow channel, by restricting the cross sectional area of the channel, in order that larger cuttings, normally not movable in fluid suspension, can now be more efficiently driven across the face of the bit.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
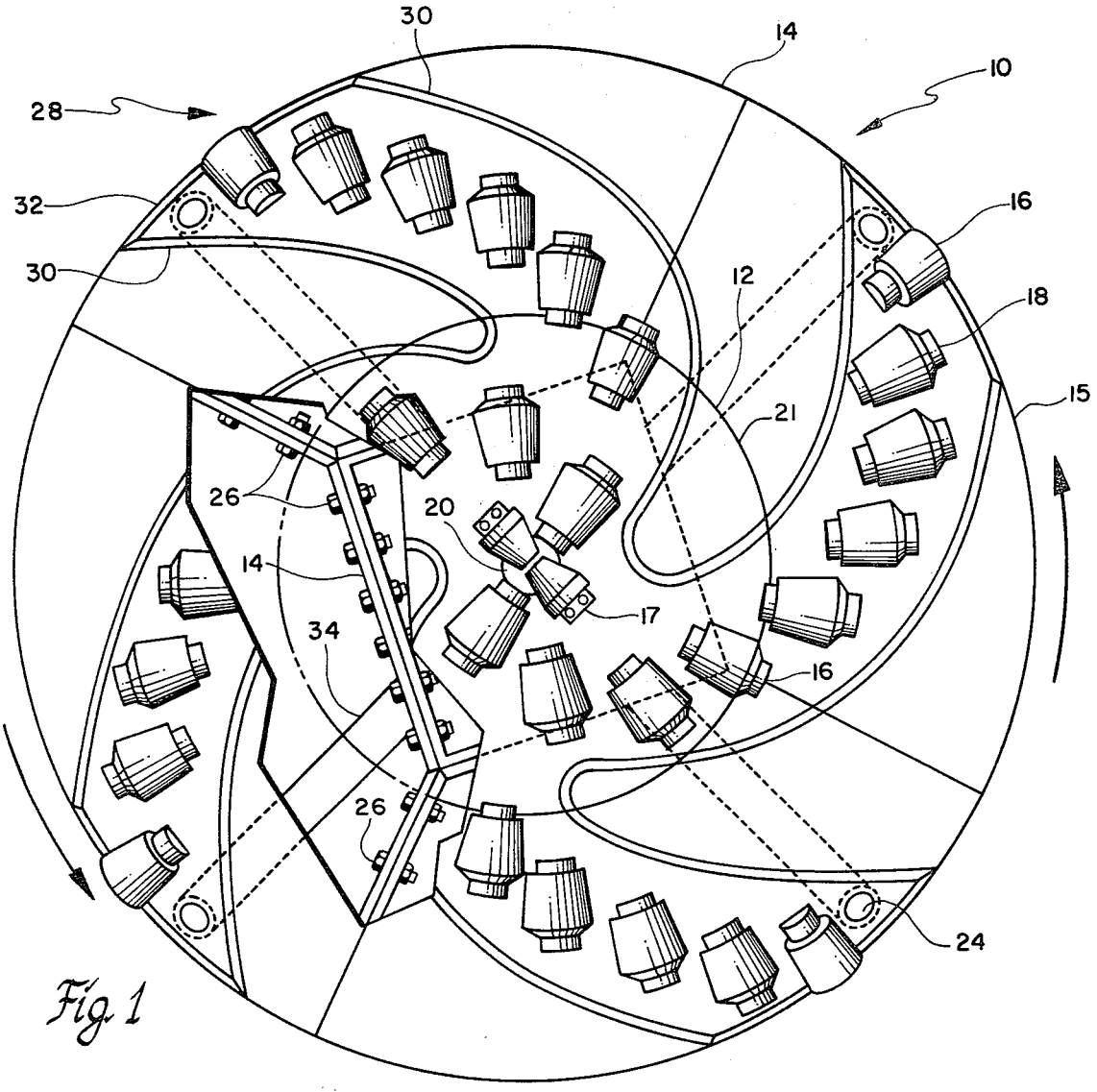
FIG. 1 is a bottom plan view of a large diameter drill bit utilizing a spiral curve flow channel and cutter arrangement. Basic construction of a step-variable diameter bit, using bolt-on outer sections, is illustrated.
Figure 2:
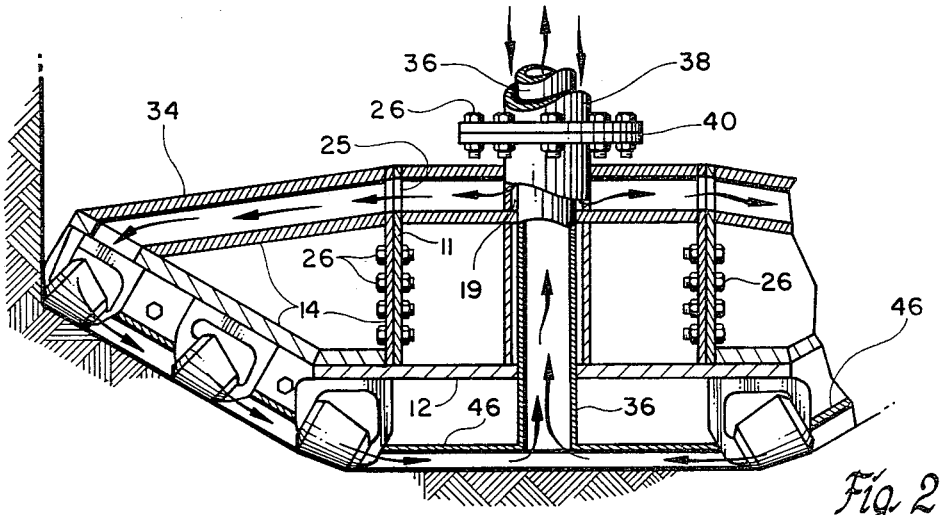
FIG. 2 is a partial cross section taken through FIG. 1 illustrating the bit body, outer sections and adaptation to a dual-string drill column.
Figure 3:
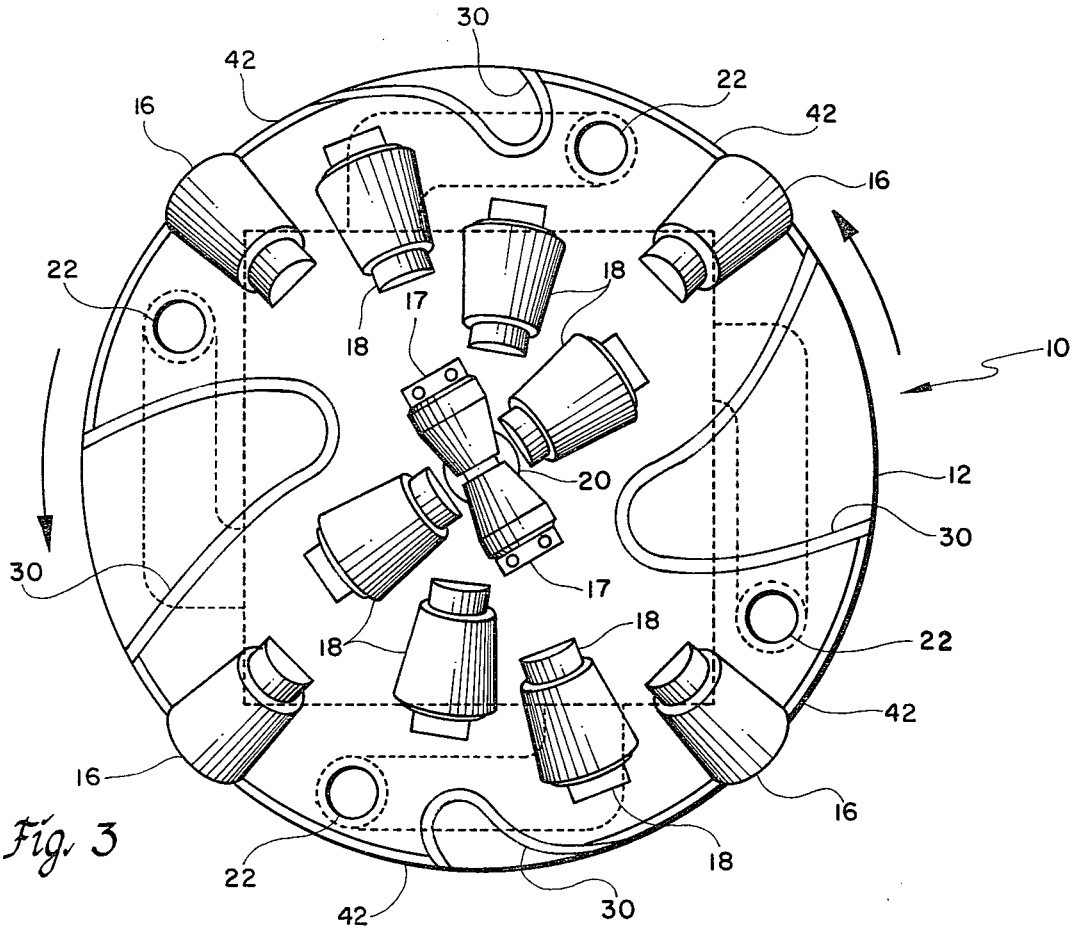
FIG. 3 is a bottom plan view of the bit of FIG. 1 with the outer sections removed from the center bit body.

Referring to FIG. 1 wherein the preferred embodiment of the drill bit generally designated as 10 is depicted, the main bit body 12 of bit 10 is radially enlarged, for example, by the addition of four contiguous quarter sections 14 which are secured by assembly bolts 26. As pictured, four spiral arcuate channels 28 are each defined by a peripheral wall member 32 and two longside wall members 30. Within each arcuate channel 28 there is an inner fluid port 22 in the main bit body 12 which supplies fluid to channels 28 when the bit is used without bolt-on enlargement sections 14 (see FIGS. 3 and 4). Port 22 is blocked by the bolted-on quarter sections 14 to enable the fluid to be redirected to each exit port 24 in sections 14. The outer fluid port 24 within each channel 28 is located near the peripheral edge 15 of the quarter section 14 and port 24 delivers drilling fluid via the fluid supply conduit 34 in each section 14. The four channels 28 radiate from the center of the bit through central opening 20 which is in communication with the interior of the inner drill pipe 36. A plurality of cutter assemblies 16 and 18 are shown mounted within each arcuate channel 28. Note in FIG. 2 that the surface being cut by the bolt-on section 14 angles upward sharply, permitting gravity to augment the flow of cuttings-laden fluid near the larger diameters 15 of sections 14. Gage row cutter assemblies 16, at peripheral edges 15 and 21, and centrally mounted cutter assembly 17 have special mounting and clearance considerations. A standard bit cutter assembly is generally designated as 18 (FIGS. 1 and 3). Gage row cutters maintain the diameter of the borehole and the central cutters 17 cut the core or center portion of the earth formation. Fluid conduit 34 is in communication with port 25, defined by wall 11 in the main bit body 12 which is in communication with the annular space 19 formed between the inner drill pipe 36 and the outer drill pipe 38, through which space fresh drilling fluid is supplied. The surface member 46 (FIG. 2) constricts the arcuate flow channel 28 to increase fluid velocity within the channel to keep cuttings in suspension. The mounting flanges 40 attach the drill column to the bit 10.

Figure 4:
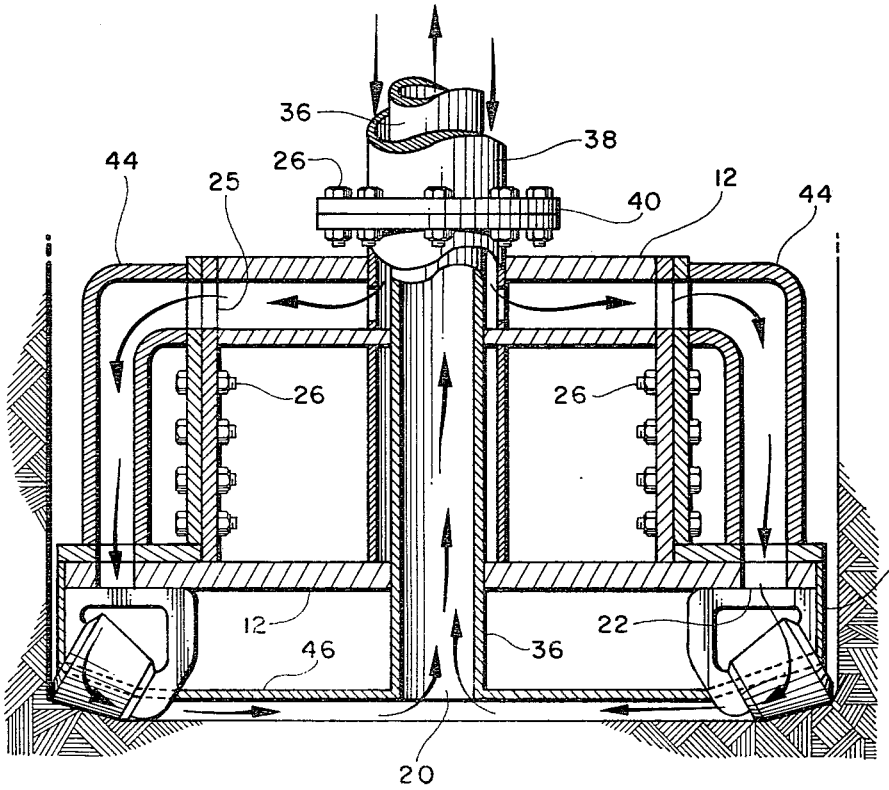
FIG. 4 is a cross section taken through FIG. 3 showing the short conduits bolted on, FIG. 5 is a bottom plan view of an alternative large diameter drill bit utilizing involute flow channels and directive vanes therein.

FIG. 3 and FIG. 4 show the main bit body 12 without bolt-on outer sections 14 attached thereto. The central main bit body 12 is adapted for drilling at the main bit body diameter 21. The short fluid supply conduits 44 are bolted to the main bit body 12, adjacent ports 25 in wall 11, in place of the outer sections 14. Conduits 44 serve to communicate with supply port 25 to the inner fluid port 22 exiting within arcuate path 28. A removable peripheral wall member 42 is mounted to each arcuate flow channel at peripheral edge 21 of body 12.

Figure 5:
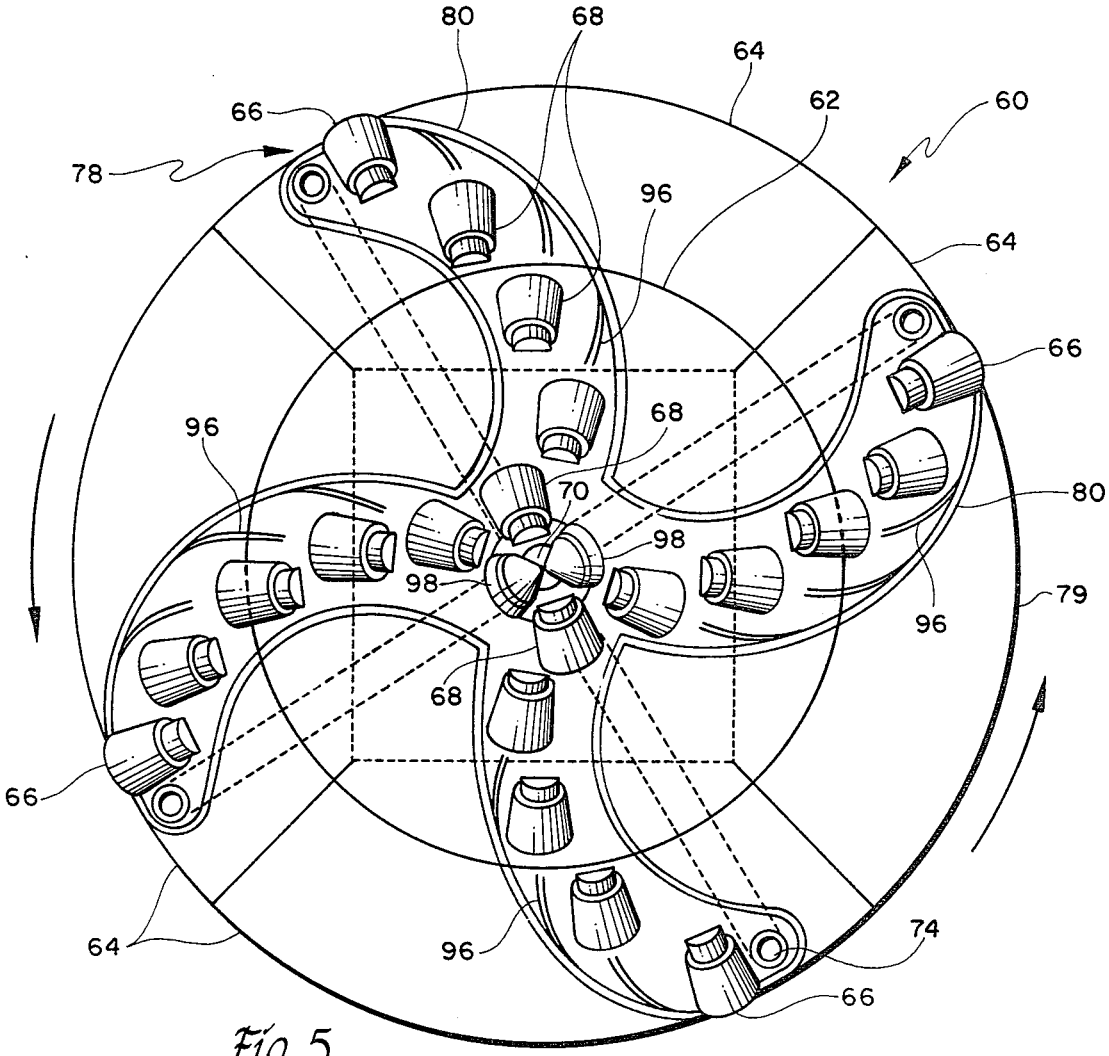

FIG. 5 illustrates another embodiment, generally designated as 60. The main bit 60 is comprised of inner bit body 62 with four contiguous quarter sections 64 attached thereto. Each of four involute arcuate flow channels 78 is defined by a pair of wall members 80. Within each arcuate channel 78 is located an outer fluid port 74, formed in section 64. Conduit means 84 conducts drill fluid from annulus 87, formed between inner pipe 86 and outer drill pipe 88, through passageway 75 in wall 77 to the outer fuid port 74. The four channels 78 become coincident near the bit center where all channels terminate at the central opening 70, defined by center body 62. Orifice 70 communicates with the interior of the inner drill pipe 86 concentric with outer drill pipe 88. A variety of cutter assemblies 68 are strategically placed within each flow channel 78. Gage cutter assemblies 66 are angled and mounted at the bit periphery 79 to cut the diameter of the borehole as previously described. Two full cone cutter assembiles 98 are used at the bit center to cut the core of the earth formation. Cutter assemblies 68 cut generally parallel to their mounting surface and are used in all other positions within channels 78. Also shown are fluid flow direction vanes 96 which are strategically positioned in the fluid flow path to cause cleaning currents to impinge the cutters in an effective manner.

Figure 6:
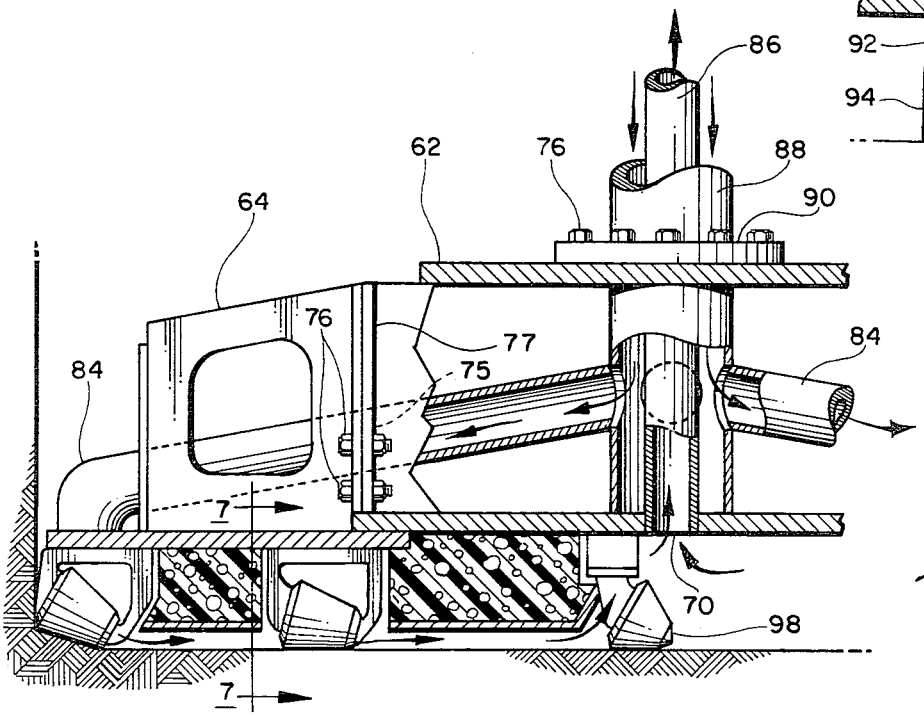
FIG. 6 is a partial cross section taken through FIG. 5 illustrating structural variations.

Referring now to FIG. 6, the bit body 62 mounts to the dual drill string 85 through mounting plate 90. The drill column 85 communicates with central opening 70, inner drill pipe 86, serving as the return conduit for detritus-containing drilling mud. The annular space 87, between the inner drill pipe 86 and the outer drill pipe 88, is in communication with the main bit body fluid conduits 84.

Figure 7:
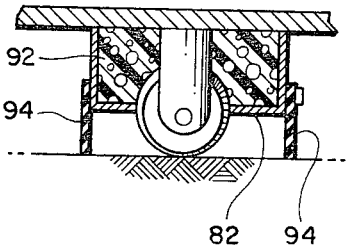
FIG. 7 is a cross section taken through 7-7 of FIG. 6 illustrating the arcuate flow channel showing the cutter mounted on the bit body, the vertical side walls of the channels, the surface member with the plastic material between the surface member and the bit body and the flexible skirts.

FIG. 7 illustrates, in a typical section taken across an arcuate flow channel 78, how the channel is constricted by the surface member 82, the replaceable flexible skirts 94 and the plastic filling material 92 to further accelerate the fluid flow to hold cuttings in suspension. Any number of foam plastic materials may be utilized. An example of this material would be polyurethane.

The large diameter rotary drill bit of the present invention, comprised of a main bit body that forms a central opening in communication with an interior of an inner dril pipe of a dual-string drill column, is rotated in an earth formation by a bit rotary table that connects the outer drill pipe of the dual-string drill pipe mounted solidly to the bit body to rotatively drive the bit. Drilling fluid is directed down the annular space formed between the outer and inner drill pipe into the bit body then through a series of conduits, the fluid exiting through ports located on the bottom circular face of the bit body near the peripheral edge of the bit. Two substantially parallel wall members, mounted on each side of the port, confine between them arcuate flow channels that lead fluid exiting the ports toward the central opening in the bit body. More than one such arcuate path may be formed on the bit face, each with its own peripheral port.

A number of relatively conventional large hole rotating cutter assemblies are mounted to the lower surface of the bit body within the arcuate channel and are strategically positioned within the channels to form a continuous cutting plane for contacting and disintegrating an earth formation. The drilling fluid, thus confined, serves to cool and clean the cutter assemblies spaced within the channels and to carry detritus material directly to the central opening.

It should be noted then, when viewing the lower cutting face of the bit, the arcuate channels wind outwardly in a counterclockwise direction so that, as the bit is rotated, the channels tend to direct or pump the drilling fluid toward the center opening.

Several methods of further confining and accelerating the fluid flow across the face of the bit are specified and may be used singularly or in any combination, such as: a peripheral wall member circumferentially directed may be used to close the outer end of the arcuate channel formed on the bit face to minimize fluid leakage at that point; the cross section of the flow channel may be reduced by adding a surface member mounted between the wall members of the channel which is substantially parallel to and spaced a predetermined distance from the cutting plane, the cutters extending through apertures formed in this surface member; replaceable, substantially flexible skirts may be used to close the space from the wall members to the cutting plane, better containing the drilling fluid; directive vanes may be mounted strategically within the channels to redirect drilling fluid towards individual cutter assemblies; the space between the added surface member and the main bit body may be filled with a semi-rigid material to prevent the fluid and cuttings from lodging therein; the cutting plane, at larger diameters, may be angled radially upward and outward so that gravitational flow will be from larger to smaller diameters; and, the arcuate paths of the channels may be either spiral in form or involute.

An additional feature of this invention is the ability to expand the bit body. The bit body is diametrically enlarged by adding bit enlargement segments and additional cutter assemblies are added thereon to permit drilling a larger diameter hole. Provision is included to confine the drilling fluid supply to the enlarged peripheral sections.

It will of course be realized that various modifications can be made in the design and operation of the present invention without departing from the spirit thereof, Thus, while the preferred construction and mode of operation of the invention have been explained in what is now considered to represent its best embodiments, which have been illustrated and described, it should be understood that within the appended claims, the invention may be practiced otherwise than as specifically illustrated and described.

We claim:

1. A large diameter rotary drill bit comprising:

a main bit body adapted for connection with a dual-string drill column, said dual-string drill column consisting of a first outer drill pipe and a second concentric inner drill pipe spaced from said outer drill pipe, said body forming a central opening in communication with said second inner drill pipe of said dual-string drill column, means to confine a supply of drilling fluid directed through said drill column outwardly to a peripheral edge of said bit body, said drilling fluid subsequently being directed along at least one arcuate flow path from said peripheral edge to said center opening formed in said bit body, a first wall member mounted to a lower surface of said bit body, said first wall member being mounted substantially 90° to said lower surface of said bit body, forming a first side of said arcuate path, and a second wall member substantially parallel with said first wall member mounted to said bit body forming a second enclosing side of said arcuate path, and a plurality of cutter assemblies rotatably mounted to said lower surface of said bit body within said first and second wall members, said plurality of said cutter assemblies being strategically positioned along said arcuate flow path to form a cutting plane for contacting and disintegrating an earth formation, said drilling fluid serves to direct detritus material along said at least one arcuate path and to clean and cool said plurality of cutter assemblies during operation of said bit.

2. The invention as set forth in claim 1 wherein said means to confine said drilling fluid comprises a conduit extending from said outer drill pipe to said peripheral edge.

3. The invention as set forth in claim 1 further comprising a third substantially circumferentially directed wall member mounted to said peripheral edge of said bit body, said third wall member being mounted substantially parallel with said drill column, extending between said first wall member and said second wall member.

4. The invention as set forth in claim 1 further comprising a surface member mounted between said first and second wall members substantially parallel to said cutting plane and spaced a predetermined distance from said cutting plane, said surface member forming an aperture around each of said plurality of cutter assemblies mounted to said bit body.

5. The invention as set forth in claim 4 further comprising filling a space formed in said arcuate path with a semi-rigid mass, said space is formed by the bottom of said main bit body, said first wall member, said second wall member, said peripheral edge of said bit body and said surface member mounted between said first and second wall members.

6. The invention as set forth in claim 5 wherein said semi-rigid mass is plastic foam.

7. The invention as set forth in claim 6 wherein said plastic foam is rigid polyurethane.

8. The invention as set forth in claim 1 further comprising a substantially flexible replaceable skirt extending from said wall members to said cutting plane, said flexible skirt serves to confine said drilling fluid within said at least one arcuate path.

9. The invention as set forth in claim 1 wherein said at least one arcuate path follows substantially a spiral curve.

10. The invention as set forth in claim 1 wherein said at least one arcuate path follows substantially an involute curve.

11. The invention as set forth in claim 1 further comprising a plurality of directive vanes strategically mounted in the arcuate channel to redirect drilling fluid toward each of said cutter assemblies.

12. The invention as set forth in claim 1 wherein said main bit body is adapted for connection with a single drill column, said central opening formed by said bit body is in communication with an interior of said drill column, and said supply of drilling fluid is directed outside of said drill column and enters said arcuate flow path at said peripheral edge of said bit body, said drilling fluid being subsequently directed to said central opening and up said drill column.

13. The invention as set forth in claim 1 wherein said bit body is diametrically enlarged by adding at least one bit enlargement segment connected to the peripheral edge of said bit body, said arcuate path defined between said first and second vertical members being extended substantially radially outwardly along a lower surface defined by said enlarged segment, terminating at a peripheral edge defined by said segment, said arcuate path defined by said enlarged segment confining additional cutter assemblies enabling said expanded bit to bore a larger diameter hole in said earth formation.

14. The invention as set forth in claim 13 wherein said bit enlargement segment angles radially upward and outward so that gravitational flow will be from said bit periphery towards said central opening formed by said bit body.

* * * * *